US010328299B2

(12) United States Patent
Wang

(10) Patent No.: US 10,328,299 B2
(45) Date of Patent: Jun. 25, 2019

(54) ADJUSTABLE EXERCISE DEVICE

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Taichung (TW)

( * ) Notice: Subject to any disclaimer, the term of this patent is extended or adjusted under 35 U.S.C. 154(b) by 225 days.

(21) Appl. No.: 15/618,172

(22) Filed: Jun. 9, 2017

(65) Prior Publication Data

US 2018/0353794 A1 Dec. 13, 2018

(51) Int. Cl.
*A63B 21/072* (2006.01)
*A63B 21/075* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0726–075; A63B 21/0615
See application file for complete search history.

(56) References Cited

U.S. PATENT DOCUMENTS 4,971,318 A * 11/1990 Tracy ..... A63B 21/0728 482/107
5,518,478 A 5/1996 Liang
5,839,997 A 11/1998 Roth et al.
6,416,446 B1 7/2002 Krull
6,656,093 B2 12/2003 Chen
6,669,606 B2 12/2003 Krull
6,682,464 B2 * 1/2004 Shifferaw ..... A63B 21/0728 482/104
6,719,674 B2 4/2004 Krull
6,733,424 B2 5/2004 Krull
7,137,931 B2 11/2006 Liu
7,153,243 B1 12/2006 Krull
7,172,536 B2 2/2007 Liu
7,223,214 B2 5/2007 Chen
7,485,077 B2 2/2009 Chen
7,534,173 B2 * 5/2009 Rees ..... A63J 1/028 472/78
7,731,641 B1 6/2010 Chen
8,025,613 B1 9/2011 Wang
2002/0107118 A1 * 8/2002 Shifferaw ..... A63B 21/0728 482/106
2004/0259696 A1 * 12/2004 Shifferaw ..... A63B 21/0615 482/94
2005/0075221 A1 * 4/2005 Fond ..... A63B 21/0724 482/93
2005/0192166 A1 * 9/2005 Shifferaw ..... A63B 21/0615 482/94

* cited by examiner

*Primary Examiner* — Nyca T Nguyen
(74) *Attorney, Agent, or Firm* — Charles E. Baxley

(57) ABSTRACT

An adjustable barbell or dumbbell or exercise device includes a handle device having a handle bar engageable into grooves of a number of weight members, the weight members each having two pivotal arms, a link pivotally connected between the arms, a hand grip disposed on the handle bar, and a number of plates disposed on the handle bar and rotated in concert with the hand grip, the plates are engageable between the weight members, and the plates each include an engaging element for engaging with the link and for moving the arms toward each other to engage with the handle device when the plates and the hand grip are rotated relative to the handle bar, and for anchoring a selected number of weight members to the handle device with the plates.

16 Claims, 14 Drawing Sheets

ADJUSTABLE EXERCISE DEVICE

BACKGROUND OF THE INVENTION

1. Field of the Invention

The present invention relates to an adjustable exercise device or dumbbell or barbell or the like, and more particularly to an adjustable exercise device or dumbbell including an improved compact structure for allowing the weight members to be easily and quickly and readily and adjustably attached to or disengaged from the weight carrier or handle and for allowing the adjustable dumbbell to be easily operated by the user.

2. Description of the Prior Art

Typical exercise devices or barbells or dumbbells comprise a central handle member to be grasped or held by the user, and a number of weight plates to be attached onto the ends of the handle member for weight lifting or exercising purposes, or for exercising or training the upper muscle groups or the lower muscle groups of the user.

For example, U.S. Pat. No. 5,518,478 to Liang, U.S. Pat. No. 5,839,997 to Roth et al., U.S. Pat. No. 6,416,446 to Krull, U.S. Pat. No. 6,656,093 to Chen, U.S. Pat. No. 6,669,606 to Krull, U.S. Pat. No. 6,719,674 to Krull, U.S. Pat. No. 6,733,424 to Krull, U.S. Pat. No. 7,137,931 to Liu, U.S. Pat. No. 7,153,243 to Krull, U.S. Pat. No. 7,172,536 to Liu, U.S. Pat. No. 7,223,214 to Chen, U.S. Pat. No. 7,485,077 to Chen, U.S. Pat. No. 7,731,641 to Chen, and U.S. Pat. No. 8,025,613 to Wang disclose several typical adjustable dumbbells each comprising a number of weight plates or weight members selectively or adjustably attaching or mounting onto the handle shaft or handle bar that is provided for being held or grasped by the users to train the upper muscle groups or the lower muscle groups of the user, and a latch device attached onto the handle and/or the weighted plates for selectively or adjustably mounting or securing selected or different number of the weighted plates on the ends of the handle and for exercising or training the upper muscle groups or the lower muscle groups of the user.

A supporting base is further required to be provided for stably supporting the weight plates or weight members in place, and the latch device is required to be moved relative to the handle or the weight plates or weight members or actuated to engage with the required or selected number of the weighted plates or weight members when the weight plates or weight members are supported on or in the supporting base, and before the handle and the weight plates or weight members may be lifted or moved away from the supporting base, and the latch device is required to be moved relative to the handle or the weight plates or weight members or actuated to engage with and to couple the required or selected number of the weighted plates or weight members to the handle before the handle and the weight plates or weight members may be lifted or moved away from the supporting base.

However, the typical adjustable dumbbells include a complicated structure or configuration that may not be easily and quickly made or manufactured by the manufacturers and that may include a complicated making or manufacturing procedure and that may include a greatly increased manufacturing cost. In addition, the weight plates or weight members may have a good chance to be disengaged from the handle and/or the supporting base inadvertently.

The present invention has arisen to mitigate and/or obviate the afore-described disadvantages of the conventional adjustable dumbbells.

SUMMARY OF THE INVENTION

The primary objective of the present invention is to provide an adjustable exercise device or barbell or dumbbell including an improved compact structure for allowing the weight members to be easily and quickly and readily and adjustably attached to or disengaged from the weight carrier or handle and for allowing the adjustable dumbbell to be easily operated by the users.

The other objective of the present invention is to provide an adjustable exercise device or barbell or dumbbell including an improved compact structure for allowing the adjustable exercise device or dumbbell to be made or manufactured by the manufacturers and to give a security to the adjustable exercise device.

In accordance with one aspect of the invention, there is provided an adjustable exercise device comprising a number of weight members each including a groove formed in the weight member respectively, and the weight members each including two arms pivotally connected together with a pivot pin for allowing the arms to be pivoted and moved toward or away from each other, a link pivotally connected between the arms, a handle device including a handle bar having an end portion selectively engageable into the grooves of the weight members, and a hand grip rotatably disposed on the handle bar, and a number of plates rotatably disposed on the handle bar and rotated in concert with the hand grip relative to the handle bar, the plates are selectively engageable between the weight members, and the plates each include an engaging element for engaging with the link and for moving the arms toward each other to engage with the handle device when the plates and the hand grip are rotated relative to the handle bar, and for selectively anchoring a selected number of weight members to the handle bar of the handle device with the plates. The arms of each of the weight members each include a jaw extended from the arm for selectively engaging with the handle device. The weight members each include a spring biasing member engaged between the arms for biasing the arms away from each other and for opening the groove of the weight member.

The arms of the weight members each include an upper portion and a lower portion, the upper portions of the arms are pivotable and moveable toward and away from each other, and the lower portions of the arms are pivotable and moveable toward and away from each other, and the link is pivotally connected between the lower portions of the arms for moving the lower portions of the arms toward and away from each other selectively.

The link includes two levers each having a first end portion pivotally connected to the arm with a pivot pin, and a second end portion, and the second end portions of the levers are pivotally connected together with a pivot axle which is provided for selectively engaging with the engaging element. The link includes a gasket engaged onto the pivot axle for selectively engaging with the engaging element.

The plates each include a barrel provided on the plate and rotatably engaged on the handle bar for spacing the plates from each other. Two of the plates each include an engaging element for selectively engaging with the link, and another plate includes three engaging elements for selectively engaging with the link. The handle device includes a follower disposed between the plates and the hand grip and rotated in concert with the plates and the hand grip relative to the handle bar.

The follower includes a number of flaps extended from the follower and spaced from each other for forming a number of notches between the flaps. The handle device includes a housing rotatably engaged on the handle bar, and the housing includes a spring biased latch for selectively engaging with either of the notches of the follower and for anchoring the follower to the housing and for preventing the follower from being rotated relative to the housing.

The housing includes a casing having a compartment formed in the casing for slidably engaging with the spring biased latch, the casing includes an orifice formed in the casing, and a base support is provided for supporting the weight members, the base support includes a key extended from the base support for selectively engaging with the orifice of the casing.

The base support includes a number of socket openings formed in the base support, and a catch extended into each of the socket openings of the base support, and the arms of each of the weight members each include a tongue for engaging with the catch of the base support and for anchoring the weight members to the base support.

The housing includes a shank secured to the housing for engaging into the grooves of the weight members and for anchoring the housing to the weight members and for preventing the housing from rotating relative to the weight members. The shank includes a window formed in the shank, and the follower includes a number of ears for selectively aligning with the window of the shank, and the ears each include a digital or numeral for being shown and seen through the window of the shank. The arms of each of the weight members each include a recess formed in the arm, and the shank includes a number of projections for selectively engaging with the recesses of the arms and for anchoring the arms of the weight members to the shank.

The housing includes a spring biased projection engageable with the follower for anchoring and positioning the follower to the housing at selected angular positions, and the follower includes a number of depressions formed in the follower for selectively engaging with the spring biased projection and for positioning the spring biased projection to the follower. The follower includes a drum extended from the follower and secured to the hand grip, and the housing is rotatably engaged on the drum.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
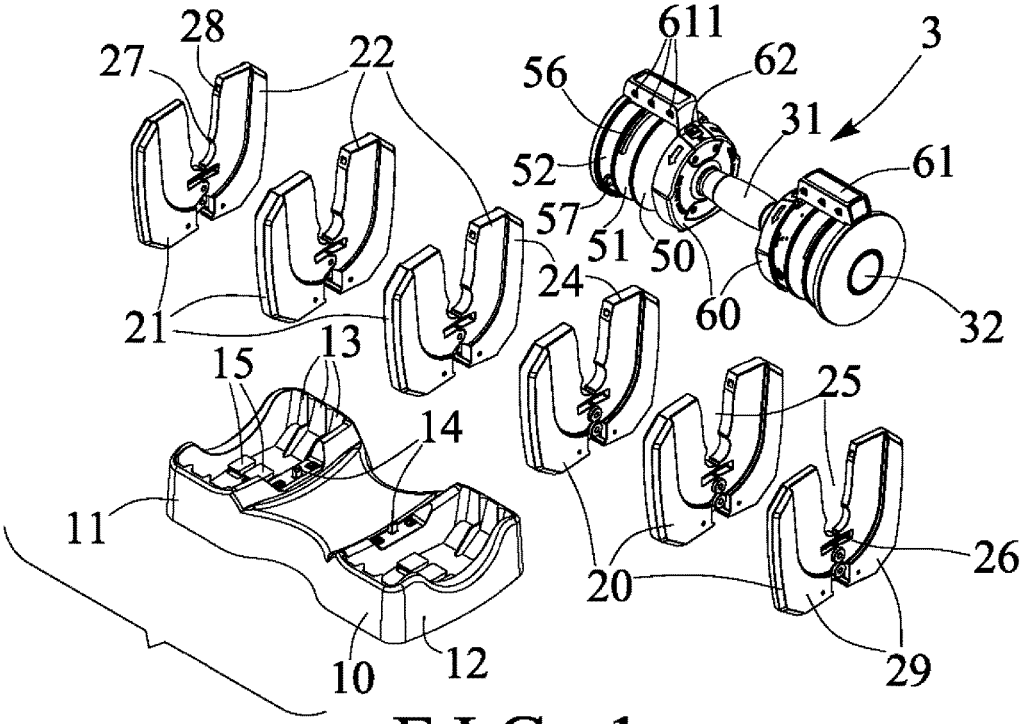
FIG. 1 is a partial exploded view of an adjustable exercise device or barbell or dumbbell in accordance with the present invention.
Figure 2:
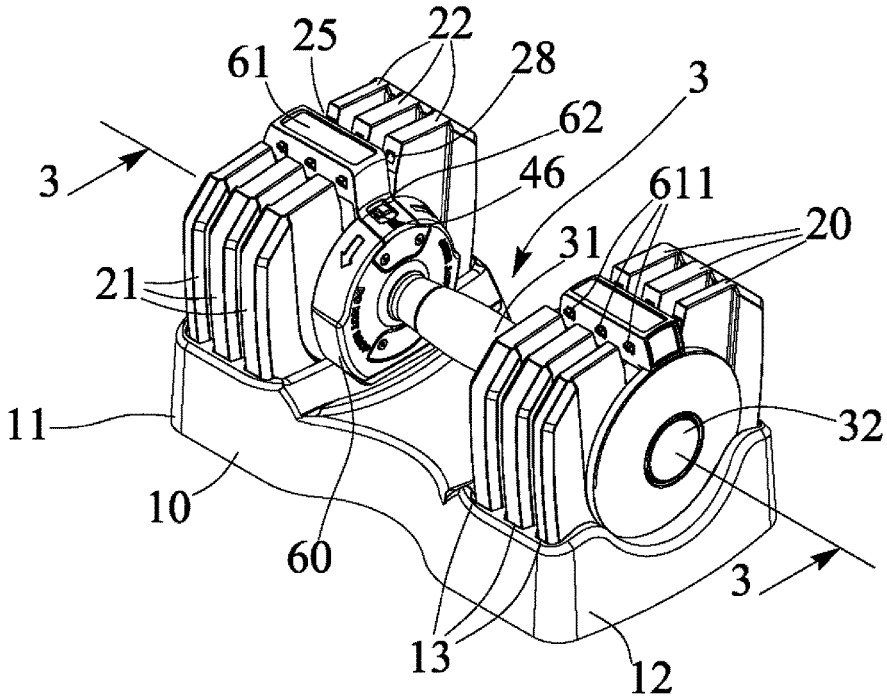
FIG. 2 is a perspective view of the adjustable dumbbell.

Referring to the drawings, and initially to FIGS. 1-8, an adjustable dumbbell or barbell or exercise device in accordance with the present invention comprises a receptacle or base support 10 including one or more (such as two) side or end portions 11, 12 each having one or more (such as three) recesses or socket openings 13 formed therein for receiving or accommodating or engaging with the weight plates or weight members 20 respectively, and each having a projection or key 14 extended upwardly therefrom, and each having one or more (such as three) locks or catches 15 extended into the socket openings 13 at each of the end portions 11, 12 of the base support 10. The weight members 20 each include two weight bodies or arms 21, 22 pivotally or rotatably connected or coupled together with a pivot pin 23 at the middle or intermediate portion thereof and arranged for allowing the arms 21, 22, such as the upper portions 24 and the lower portions 29 of the arms 21, 22 to be pivoted or moved toward or away from each other.

The weight members 20 each include a U-shaped opening or groove 25 formed therein, such as formed in the upper portion 24 thereof and located above the pivot pin 23. The weight members 20 each further include a spring biasing member 26 contacted or engaged between the arms 21, 22, particularly the upper portions 24 of the arms 21, 22 for biasing and forcing or moving the upper portions 24 of the arms 21, 22 away from each other and/or for opening the U-shaped groove 25 of the arms 21, 22 or of the weight members 20. The arms 21, 22 of the weight members 20 each include a pawl or jaw 27 extended therefrom and extended into the groove 25 of the arms 21, 22, and the jaws 27 of the arms 21, 22 of each of the weight members 20 are extended toward each other, and the arms 21, 22 of the weight members 20 each further include a depression or recess 28 formed therein, such as formed in the inner side at the upper portion 24 thereof, and a jaw or pawl or tongue 290 extended therefrom, and the recesses 28 and the tongues 290 of the arms 21, 22 of the respective weight member 20 are faced or directed toward each other respectively.

In operation, as shown in FIGS. 1, 3 and 10-12, when the arms 21, 22 of the weight members 20 are disposed or engaged into the socket openings 13 of the base support 10, the upper portions 24 of the arms 21, 22 may be pivoted or biased and forced and moved away from each other with the spring biasing member 26, and the U-shaped groove 25 of the arms 21, 22 or of the weight members 20 may be opened for receiving or engaging with a handle device 3. For example, as shown in FIGS. 1-8, the handle device 3 includes a longitudinal spindle or handle bar 30 having a hand grip 31 rotatably disposed or provided on the middle or intermediate portion of the handle bar 30 for being grasped or held by the user and for carrying or lifting or moving the handle device 3 and for allowing the adjustable dumbbell to be easily operated by the user, and the hand grip 31 is rotatable relative to the handle bar 30. One or more (such as two) end plates or end members 32 are attached or mounted or secured to the end portions of the handle bar 30 respectively for anchoring purposes.

One or more (such as two) followers 40 are rotatably disposed or provided on the end portions of the handle bar 30 and mounted or secured or coupled to the hand grip 31 and pivoted or rotated in concert with the hand grip 31 relative to the handle bar 30, the followers 40 each include a cylindrical member or drum 41 formed or provided on the middle or center portion thereof (FIG. 6) and rotatably engaged on the handle bar 30 and extended toward the hand grip 31 and engaged with or secured to the hand grip 31 with a toothed or serrated mechanism 42 for allowing the followers 40 to be pivoted or rotated in concert with the hand grip 31 relative to the handle bar 30. The followers 40 each include one or more (such as six), or a number of flaps 43 laterally extended from the outer peripheral portion thereof and equally spaced from each other and extended toward the hand grip 31 for forming or defining one or more (such as six), or a number of equally spaced gaps or notches 44 between the flaps 43.

Figure 6:
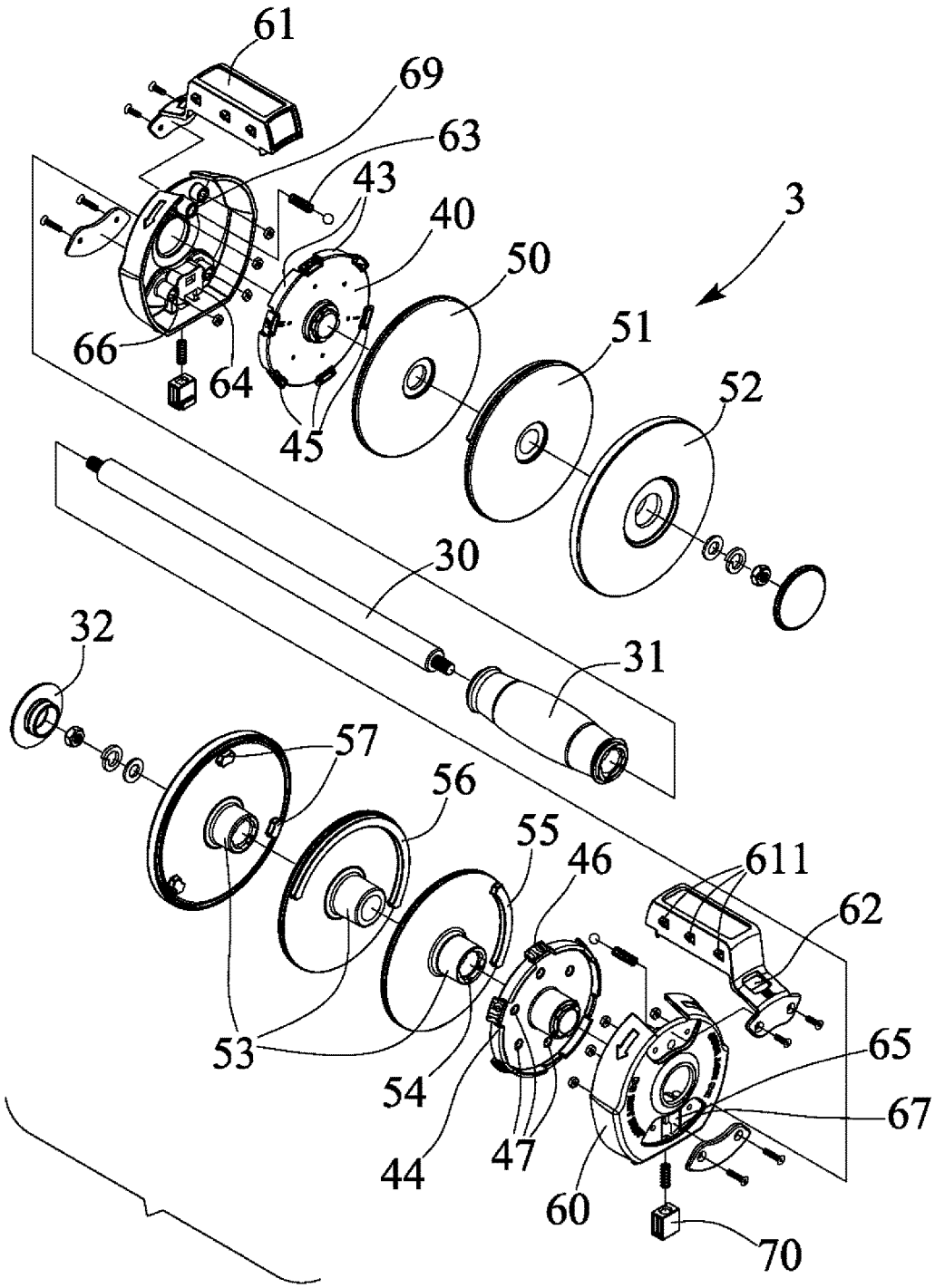
FIG. 6 is a partial exploded view of the handle device of the adjustable dumbbell.
Figure 7:
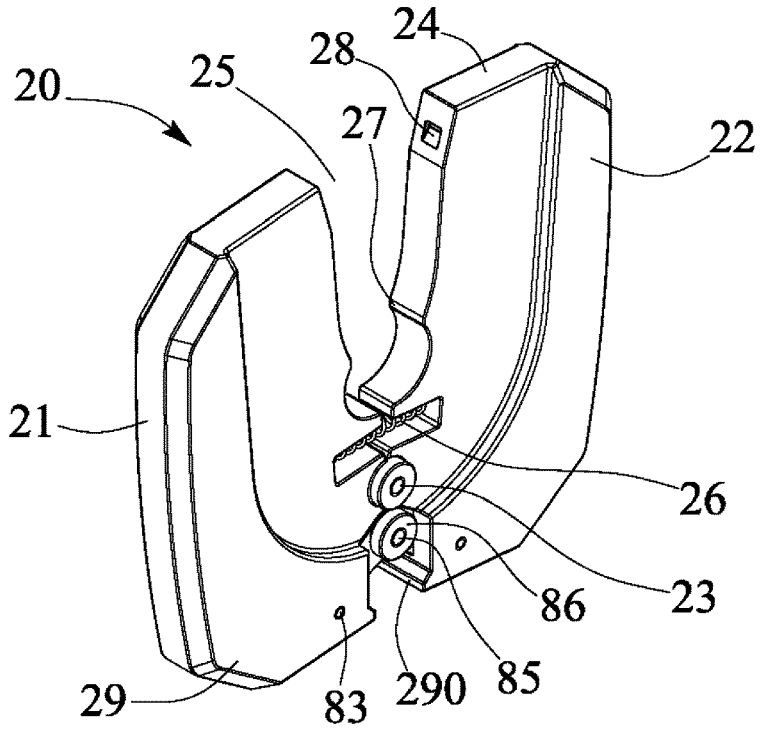
FIG. 7 is a further perspective view illustrating a weight member of the adjustable dumbbell.
Figure 8:
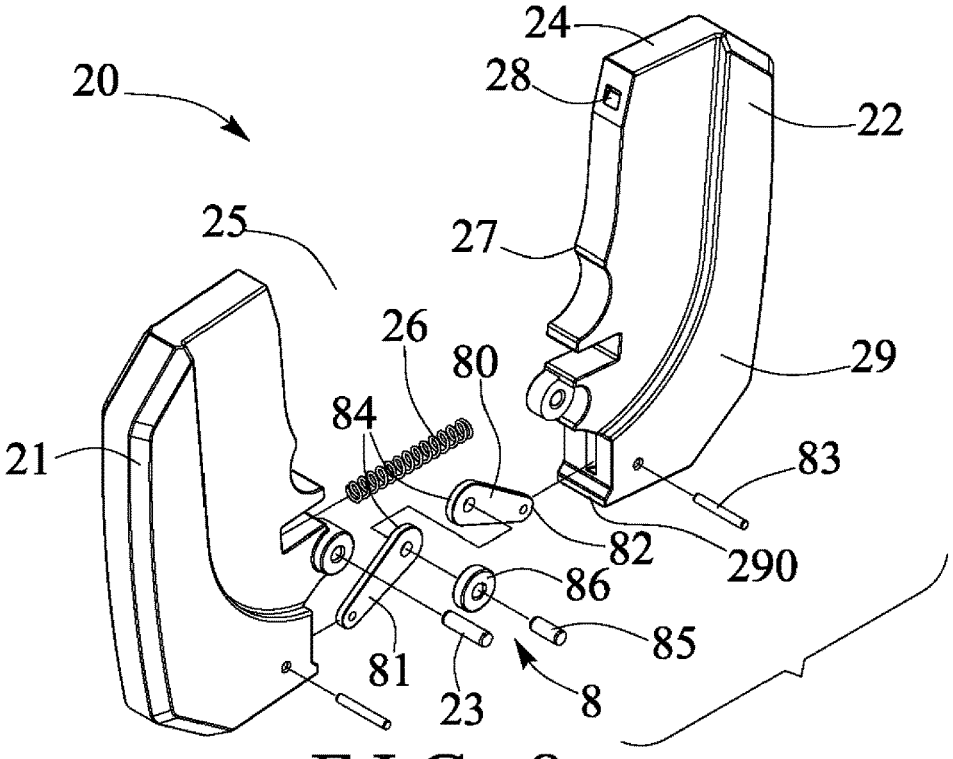
FIG. 8 is another partial exploded view of the weight member of the adjustable dumbbell.
Figure 9:
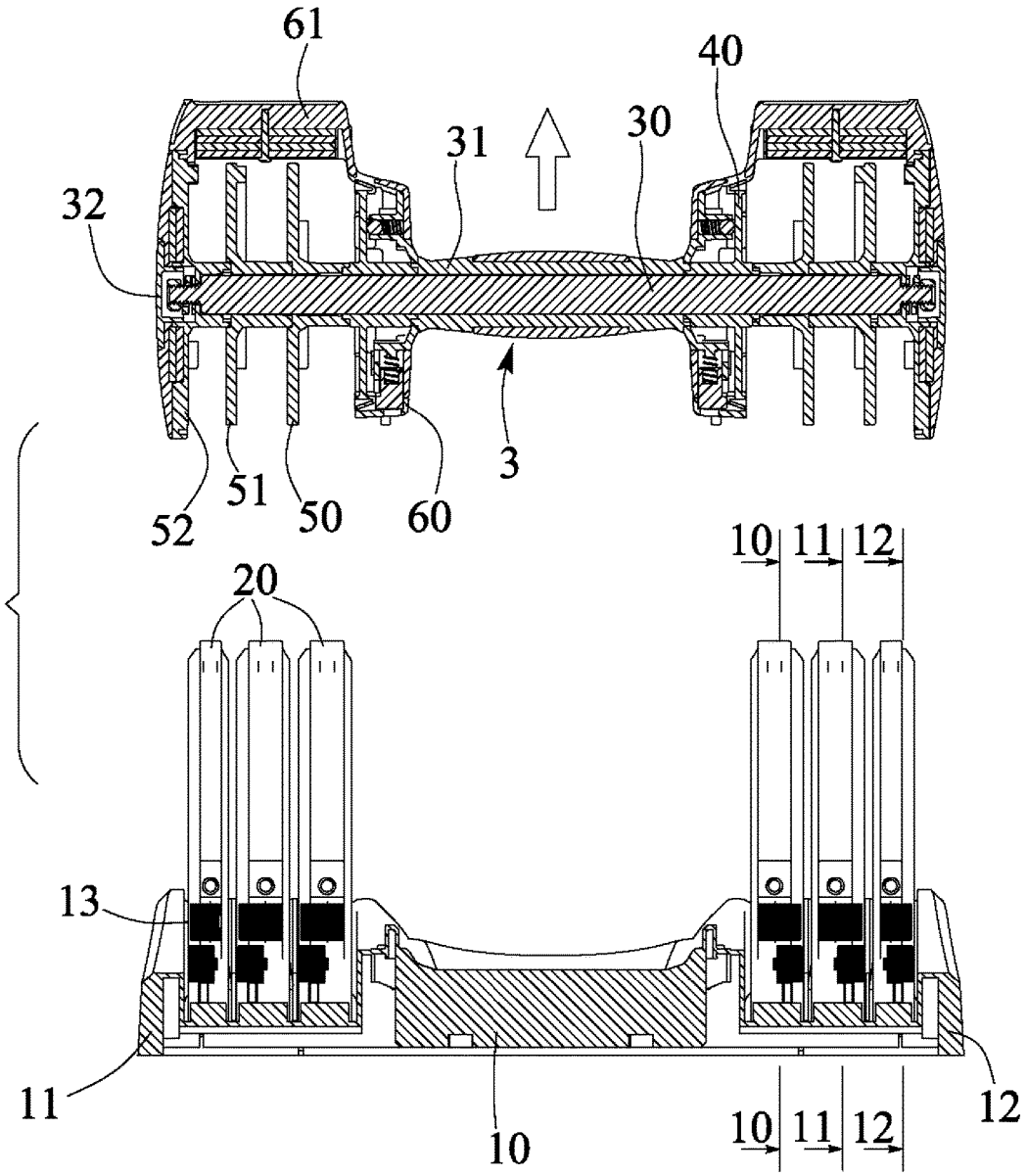
FIG. 9 is a partial exploded and cross sectional view similar to FIG. 4, illustrating the operation of the adjustable dumbbell.
Figure 10:
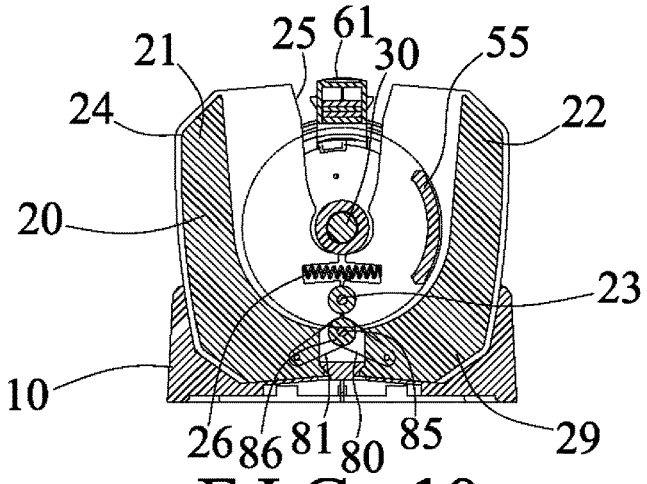
FIGS. 10, 11, 12 are partial cross sectional views of the adjustable dumbbell, taken along lines 10-10, 11-11, 12-12 of FIG. 9 respectively.
Figure 11:
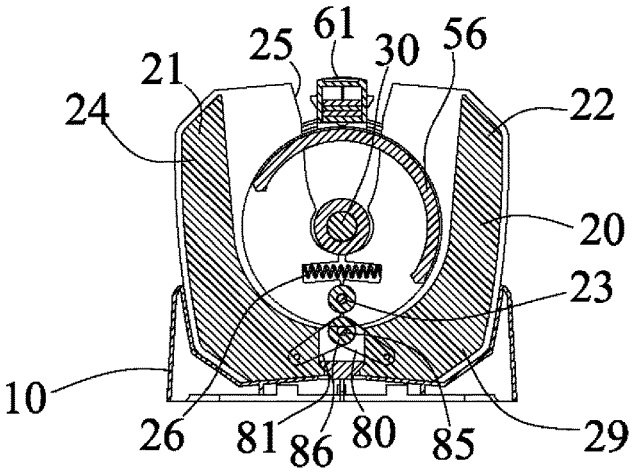
Figure 12:
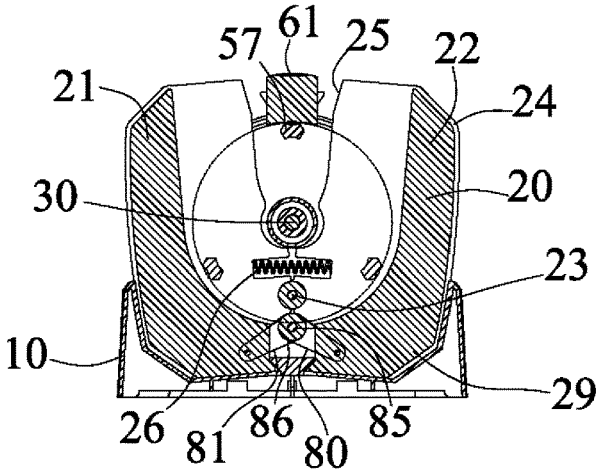

As also shown in FIG. 6, the followers 40 each further include one or more (such as six), or a number of equally spaced ears 45 formed or provided or extended in the notches 44 of the followers 40 respectively, and the ears 45 each include a mark or digital or numeral 46 formed or provided thereon for weight indicating purposes. The followers 40 each further include one or more (such as six), or a number of equally spaced recesses or depressions 47 formed in one side portion thereof and faced or directed toward the hand grip 31. One or more (such as three) spacing panels or plates 50, 51, 52 are also rotatably disposed or provided on each of the end portions of the handle bar 30 and disposed between the follower 40 and the end member 32 respectively, and the plates 50, 51, 52 each include a cylindrical member or barrel 53 formed or provided on the middle or center portion thereof and rotatably engaged on the handle bar 30 and extended toward the other plates 50, 51 or the followers 40 for separating or spacing the plates 50, 51, 52 and the followers 40 from each other.

Figure 15:
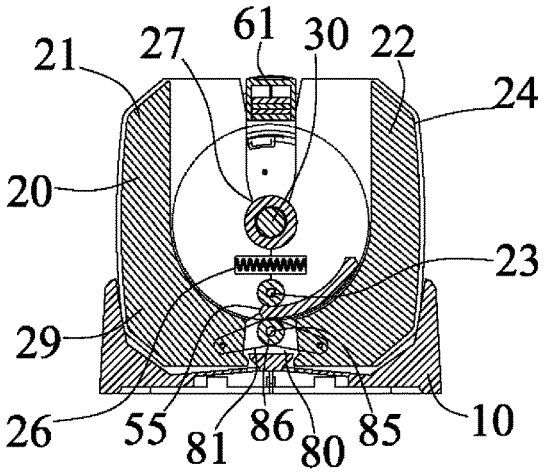
FIGS. 15, 16, 17 are further partial cross sectional views similar to FIGS. 10-12, illustrating the operation of the adjustable dumbbell.
Figure 16:
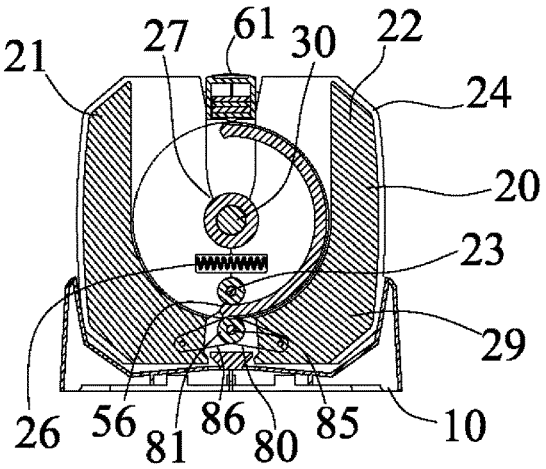
Figure 17:
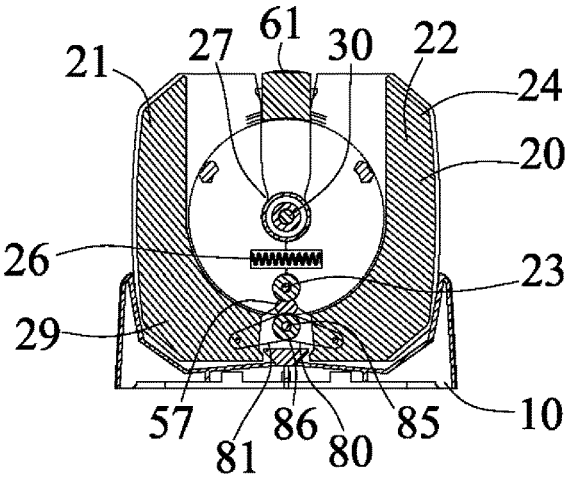
Figure 18:
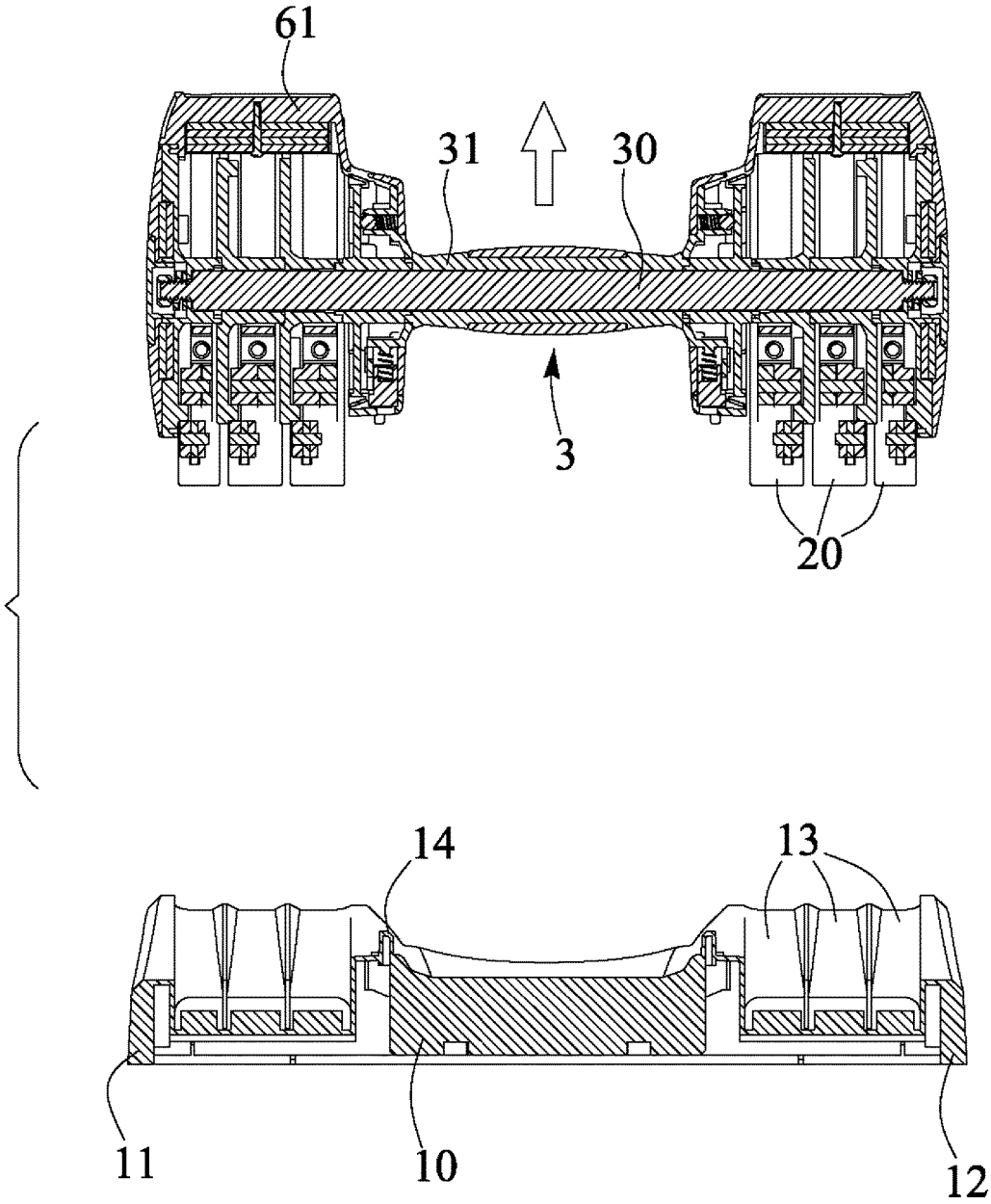
FIG. 18 is another partial exploded and cross sectional view similar to FIGS. 4 and 9, illustrating the operation of the adjustable dumbbell as shown in FIGS. 15-17.
Figure 19:
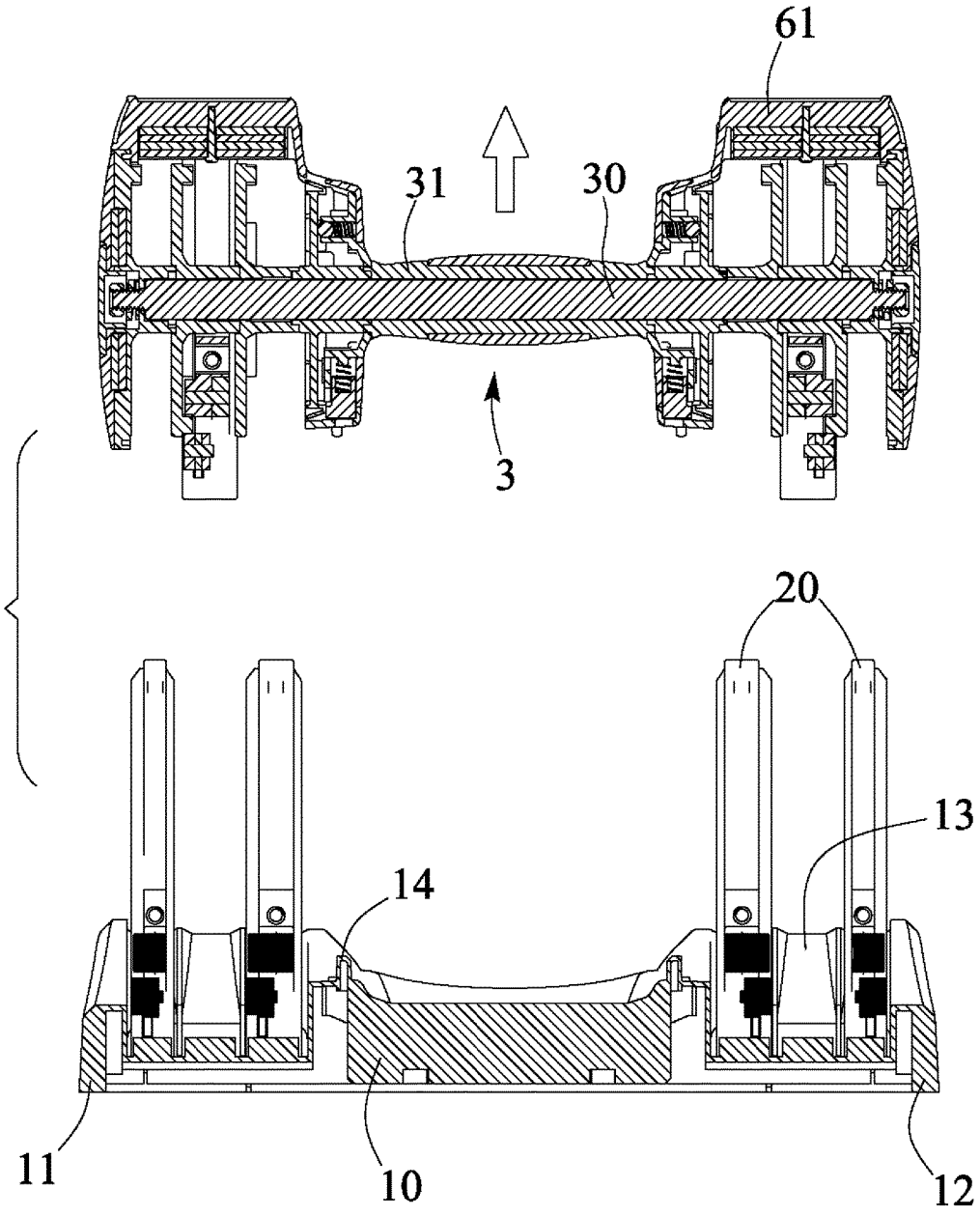
FIG. 19 is a further partial exploded and cross sectional view similar to FIGS. 4, 9 and 18, illustrating the operation of the adjustable dumbbell.
Figure 20:
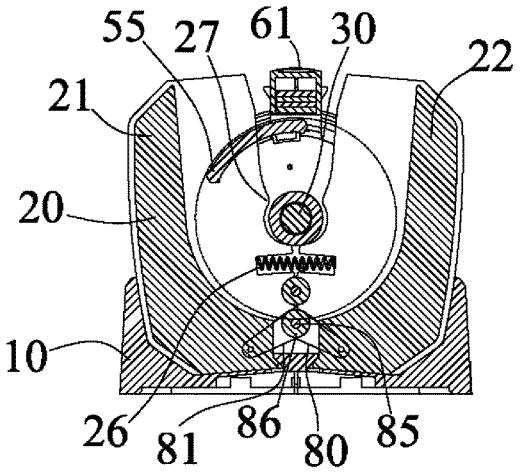
FIGS. 20, 21, 22 are still further partial cross sectional views illustrating the operation of the adjustable dumbbell as shown in FIG. 19.
Figure 21:
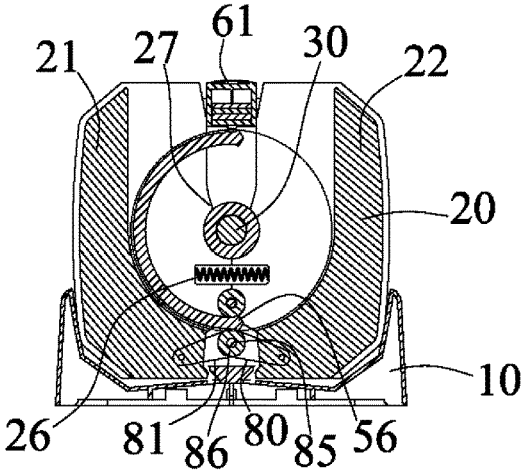
Figure 22:
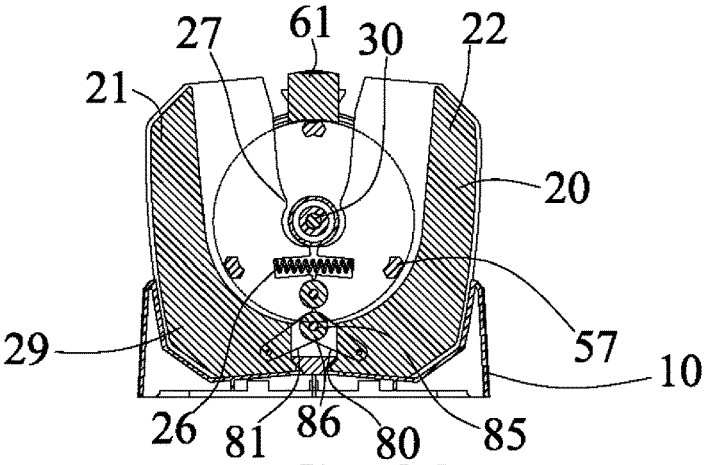

For example, the first plate 50 is disposed located closer to the follower 40, and the second plate 51 is disposed and arranged or located between the first and the third plates 50, 52, and the third plate 52 is disposed and arranged or located closer to the end member 32 respectively, the barrels 53 of the second and the third plates 51, 52 are extended toward the first and the second plates 50, 51 respectively, and the barrels 53 of the first and the second plates 50, 51 are extended toward the follower 40 and the first plate 50 respectively, and the barrels 53 of the plates 50-52 are engaged with each other or secured together with a toothed or serrated mechanism 54 (FIG. 6) for allowing the plates 50-52 and the followers 40 to be pivoted or rotated in concert with the hand grip 31 relative to the handle bar 30. The plates 50, 51, 52 each include one or more engaging or anchoring members or elements 55, 56, 57 formed or provided on the inner peripheral portion of the plates 50-52 respectively, for selectively engaging with the weight members 20 (FIGS. 15-17).

For example, as shown in FIGS. 6 and 15-17, the first plate 50 includes an engaging element 55 which extend or which include a curvature or length of about one fifth of the outer peripheral portion of the first plate 50, and the second plate 51 includes an engaging element 56 which extend or which include a curvature or length of about one half of the outer peripheral portion of the second plate 51, and the third plate 52 includes one or more (such as three) equally spaced engaging elements 57 each of which include a curvature or length of about one eighteenth of the outer peripheral portion of the third plate 52 for selectively engaging with the weight members 20 respectively when the followers 40 and the plates 50, 51, 52 are rotated relative to the handle bar 30 with the hand grip 31, and for selectively forcing and moving the upper portions 24 and the jaws 27 of the arms 21, 22 toward each other, and for selectively anchoring or latching or retaining the selected numbers of the weight members 20 to the handle bar 30 of the handle device 3 with the plates 50, 51, 52 (FIGS. 9-12, 15-22).

In operation, as shown in FIGS. 3 and 10-12, the end portions of the handle bar 30 and the barrels 53 of the plates 50-52 may be engaged into the grooves 25 of the weight members 20 for allowing the plates 50-52 to be engaged into the spaces between the weight members 20 and/or for allowing the weight members 20 to be engaged between the plates 50-52 and the followers 40. As shown in FIGS. 9-12, 15-22, the followers 40 and the plates 50-52 may be rotated relative to the handle bar 30 with the hand grip 31 for selectively engaging the engaging elements 55-57 with the weight members 20 respectively, and for selectively forcing and moving the upper portions 24 and the jaws 27 of the arms 21, 22 toward each other, and for selectively anchoring or latching or retaining the selected numbers of the weight members 20 to the handle bar 30 of the handle device 3 with the plates 50-52 due to the arrangement or the engagement of the engaging elements 55-57 of the plates 50-52 with the weight members 20, such as the pivot pin 23 of the weight members 20 respectively.

The adjustable exercise device or dumbbell further comprises one or more (such as two) control ferrules or housings 60 rotatably disposed or engaged on the handle bar 30 and/or the drums 41 of the followers 40 respectively, and an anchor lever or shank 61 mounted or secured to the respective housing 60 and to be engaged into the grooves 25 of the weight members 20 for anchoring or latching or retaining or positioning the housings 60 to the weight members 20 and for preventing the housings 60 from moving or pivoting or rotating relative to the weight members 30, and the shank 61 includes an opening or window 62 formed and provided therein for selectively aligning with the ears 45 of the followers 40 and for allowing the numeral 46 of the ear 45 of the follower 40 to be seen through the window 62 of the shank 61 of the housing 60 selectively (FIGS. 1-5). The housings 60 each include an orifice 69 formed therein (FIG. 6) for slidably receiving or engaging with a spring biased projection 63 (FIGS. 3-4, 6) which is engageable with either of the depressions 47 of the followers 40 and for anchoring or positioning the follower 40 to the housing 60 at the selected or predetermined angular position.

Figure 3:
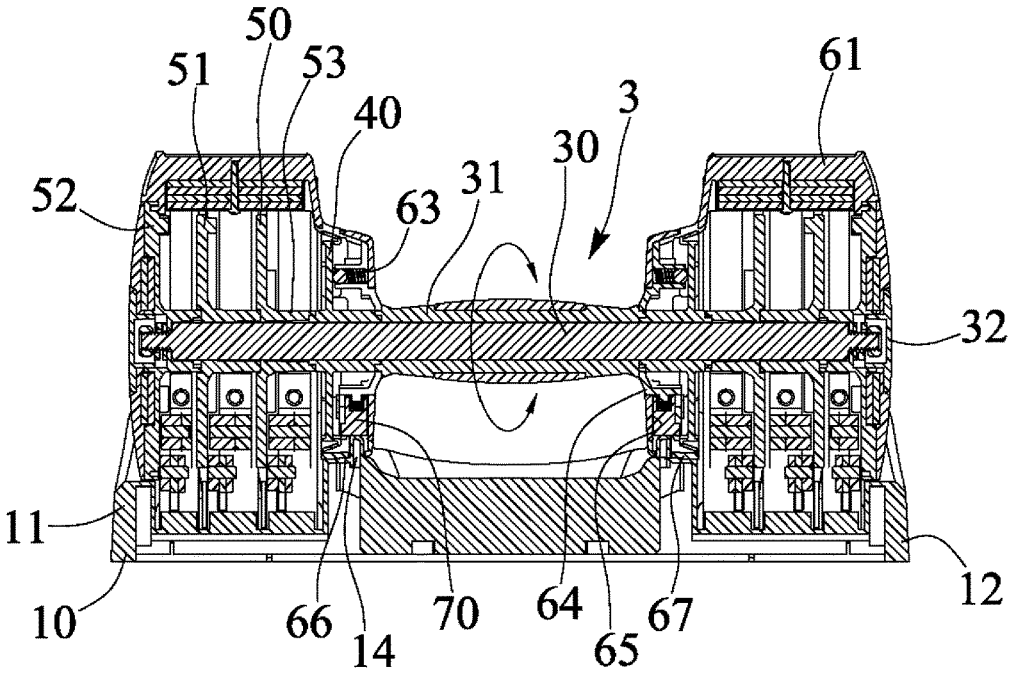
FIG. 3 is a cross sectional view of the adjustable dumbbell, taken along lines 3-3 of FIG. 2.
Figure 4:
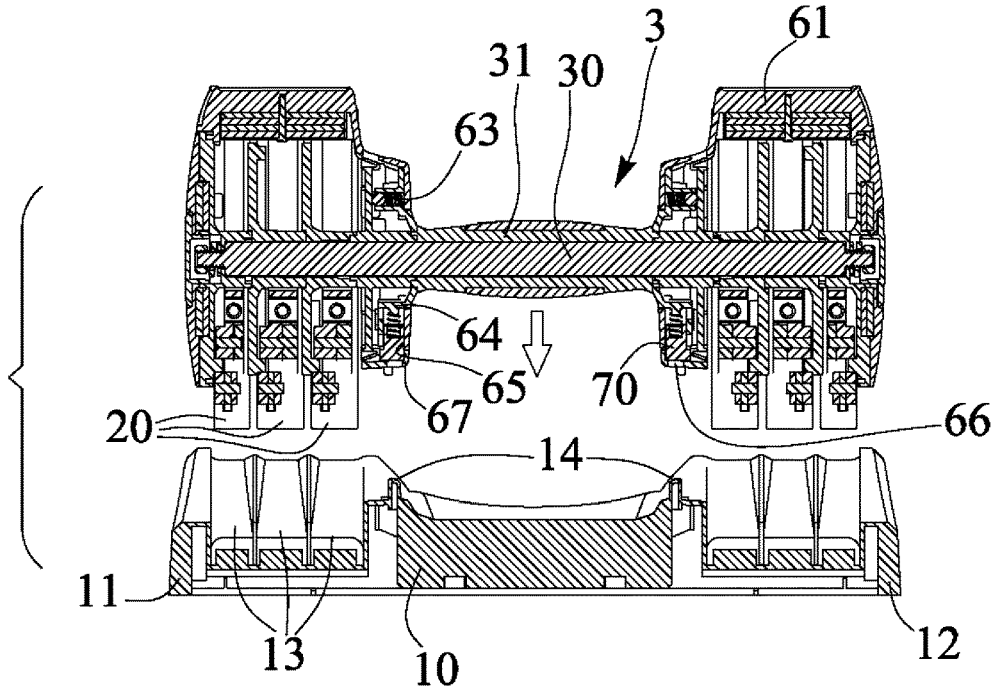
FIG. 4 is a partial exploded and cross sectional view of the adjustable dumbbell, illustrating the operation of the adjustable dumbbell.
Figure 5:
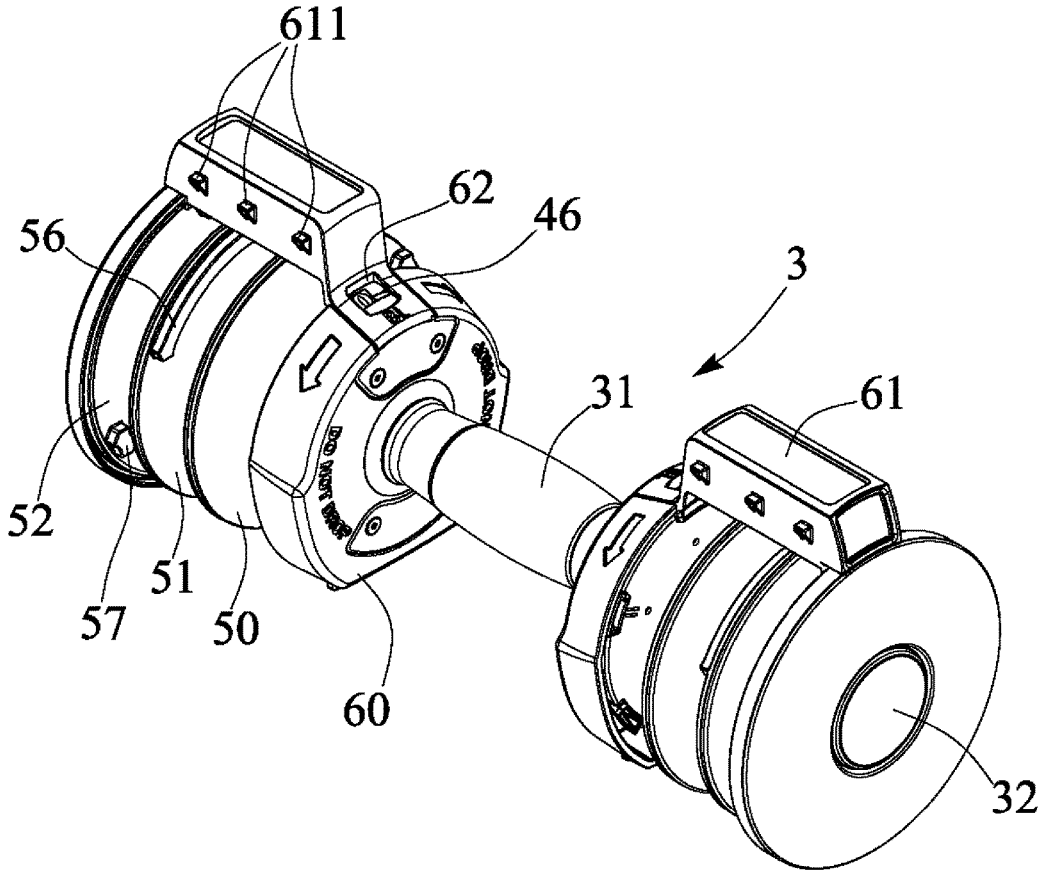
FIG. 5 is another perspective view illustrating a handle device of the adjustable dumbbell.

The housings 60 each further include a receptacle or casing 64 formed and provided therein (FIG. 6), and a chamber or compartment 65 formed in the casing 64 (FIGS. 3-4, 6) for slidably receiving or engaging with a spring biased lock or latch 70 therein, and an orifice 66 formed in a bottom wall 67 of the casing 64 and communicating with the compartment 65 of the casing 64 for selectively receiving or engaging with the key 14 of the base support 10 (FIG. 3). The latch 70 may be biased to selectively engage with either of the notches 44 of the followers 40 that are formed or provided between the flaps 43 of the follower 40 (FIG. 6) and to prevent the followers 40 and the plates 50-52 and the hand grip 31 from being pivoted or rotated relative to the handle bar 30 and the housings 60, when the followers 40 and the handle device 3 are removed or disengaged or separated from the key 14 of the base support 10 (FIG. 4).

In operation, as shown in FIG. 3, when the handle device 3 and the followers 40 and the plates 50-52 are engaged into the grooves 25 of the weight members 20 that are supported on the base support 10, and when the keys 14 of the base support 10 are engaged into the orifices 66 of the bottom walls 67 of the casings 64 respectively, the keys 14 of the base support 10 may be contacted or engaged with the latch 70 for disengaging or separating the latch 70 from the notches 44 and the flaps 43 of the followers 40 and for allowing the followers 40 and the hand grip 31 of the handle device 3 and the plates 50-52 to be pivoted or rotated relative to the base support 10 and the handle bar 30. At this moment, the keys 14 of the base support 10 are engaged with the orifices 66 of the bottom walls 67 of the casings 64 respectively such that the housings 60 are anchored or positioned or retained to the base support 10 and may not be pivoted or rotated or moved relative to the base support 10 and the handle bar 30.

The followers 40 and the plates 50-52 may thus be rotated relative to the handle bar 30 with the hand grip 31 for selectively engaging with the weight members 20 and for selectively anchoring or latching or retaining the selected numbers of the weight members 20 to the handle bar 30 of the handle device 3 with the plates 50-52 (FIGS. 12-22). As shown in FIGS. 1 and 4, when the handle device 3 and the followers 40 and the plates 50-52 are removed or disengaged or separated from the base support 10 and the weight members 20, and when the keys 14 of the base support 10 are removed or disengaged or separated from the orifices 66 of the bottom walls 67 of the casings 64 of the housings 60, the latch 70 may be biased and forced and moved to engage with either of the notches 44 of the followers 40 that are formed or provided between the flaps 43 of the follower 40 and to prevent the followers 40 and the plates 50-52 and the hand grip 31 from being pivoted or rotated or moved relative to the handle bar 30 and the housings 60 at this moment.

As shown in FIGS. 9-12, when none of the engaging elements 55-57 of the plates 50-52 are engaged with the pivot pins 23 of the weight members 20, the upper portions 24 and the jaws 27 of the arms 21, 22 may not be moved and forced toward each other and none of the weight members 20 may be anchored or retained to the handle bar 30 of the handle device 3 with the plates 50-52, such that none of the weight members 20 may be moved out of the base support 10 by or with the handle device 3 when the handle device 3 is moved away from the base support 10. As shown in FIGS. 7-8 and 10-14, the weight members 20 each include a link 8 which include two levers 80, 81 each having first or outer end portions 82 pivotally or rotatably connected or coupled to the arms 21, 22 with a pivot pin 83 and second or inner end portions 84 pivotally or rotatably connected or coupled together with a pivot axle 85 and/or a washer or ring member or gasket 86 which is engaged onto the pivot axle 85.

As shown in FIGS. 15-18, when all of the engaging elements 55-57 of the plates 50-52 are engaged with the pivot pins 23 of the weight members 20 and/or the pivot axle 85 and/or the gasket 86 of the link 8, the lower portions 29 of the arms 21, 22 may be pivoted or moved away from each other with the levers 80, 81 of the link 8, and the jaws 27 of the arms 21, 22 may be moved toward each other in order to engage with the handle bar 30 and/or the hand grip 31 of the handle device 3 and to selectively anchor or latch or retain all of the weight members 20 to the handle device 3 with the engaging elements 55-57 of the plates 50, 51, 52. Similarly, as shown in FIGS. 19-22, the selected numbers of the weight members 20 may be selectively anchored or retained to the handle bar 30 of the handle device 3 with either or some of all of the plates 50-52 when the hand grip 31 of the handle device 3 and the plates 50-52 and the followers 40 are pivoted or rotated relative to the base support 10 and the handle bar 30 and when the engaging elements 55-57 of the selected plates 50-52 are engaged with the pivot pins 23 of the selected weight members 20 and/or the pivot axle 85 and/or the gasket 86 of the link 8.

Figure 13:
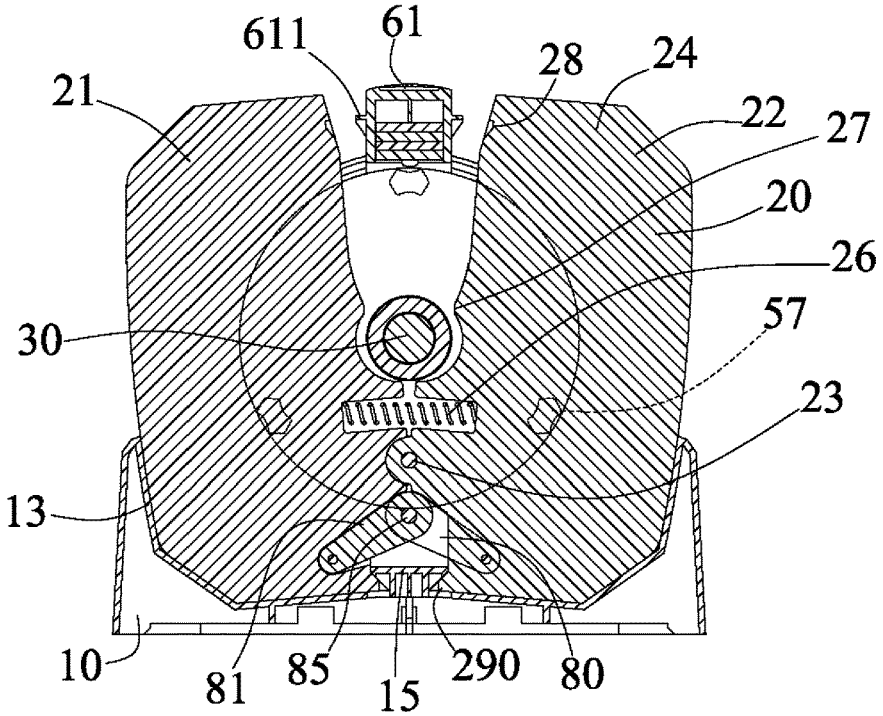
FIGS. 13, 14 are other partial cross sectional views similar to FIGS. 10-12, illustrating the operation of the adjustable dumbbell.
Figure 14:
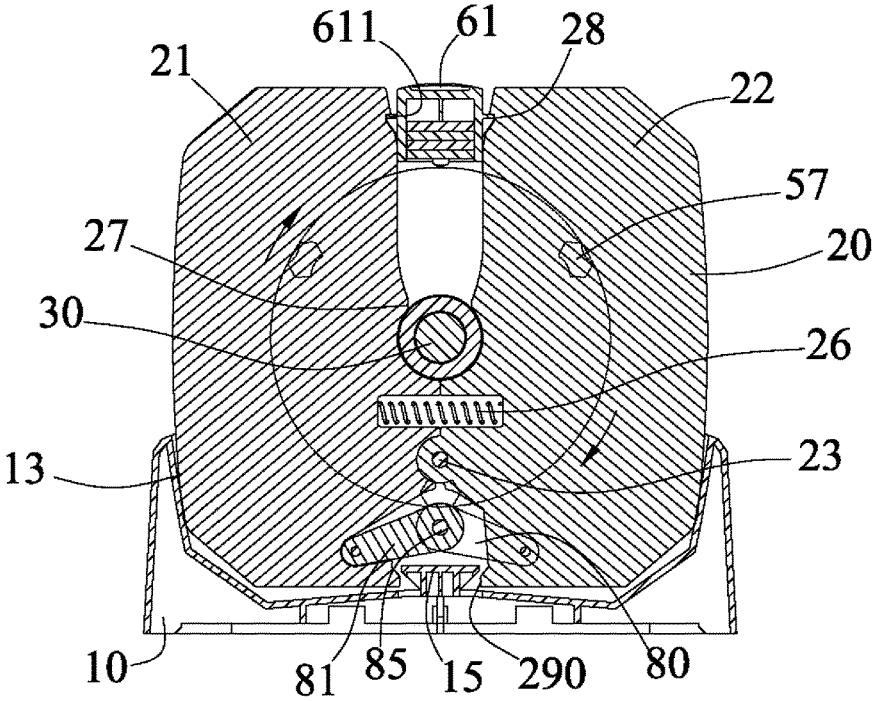

The total weight of the selected numbers of the weight members 20 that are anchored or retained to the handle bar 30 of the handle device 3 may be reflected and indicated with the numeral 46 of the ear 45 of the follower 40 and may be seen through the window 62 of the shank 61 of the housing 60 selectively (FIGS. 1-5). As shown in FIGS. 1-2, 5-6, and 13-14, the shanks 61 each may include one or more (such as three) pairs of projections 611 laterally extended therefrom for selectively engaging with the recesses 28 of the arms 21, 22 of the respective weight member 20 (FIG. 14) and for solidly and stably anchoring or latching or retaining the weight member 20 to the shank 61 of the housing 60 and thus to the handle bar 30 of the handle device 3 and for preventing the weight member 20 from being disengaged or separated from the handle bar 30 of the handle device 3. As shown in FIG. 13, the tongues 290 of the arms 21, 22 of the respective weight member 20 may be engaged with the catches 15 of the base support 10 for further solidly and stably anchoring or latching or retaining the weight member 20 to the base support 10 when the lower portions 29 of the arms 21, 22 are pivoted or moved toward each other.

Figure 23:
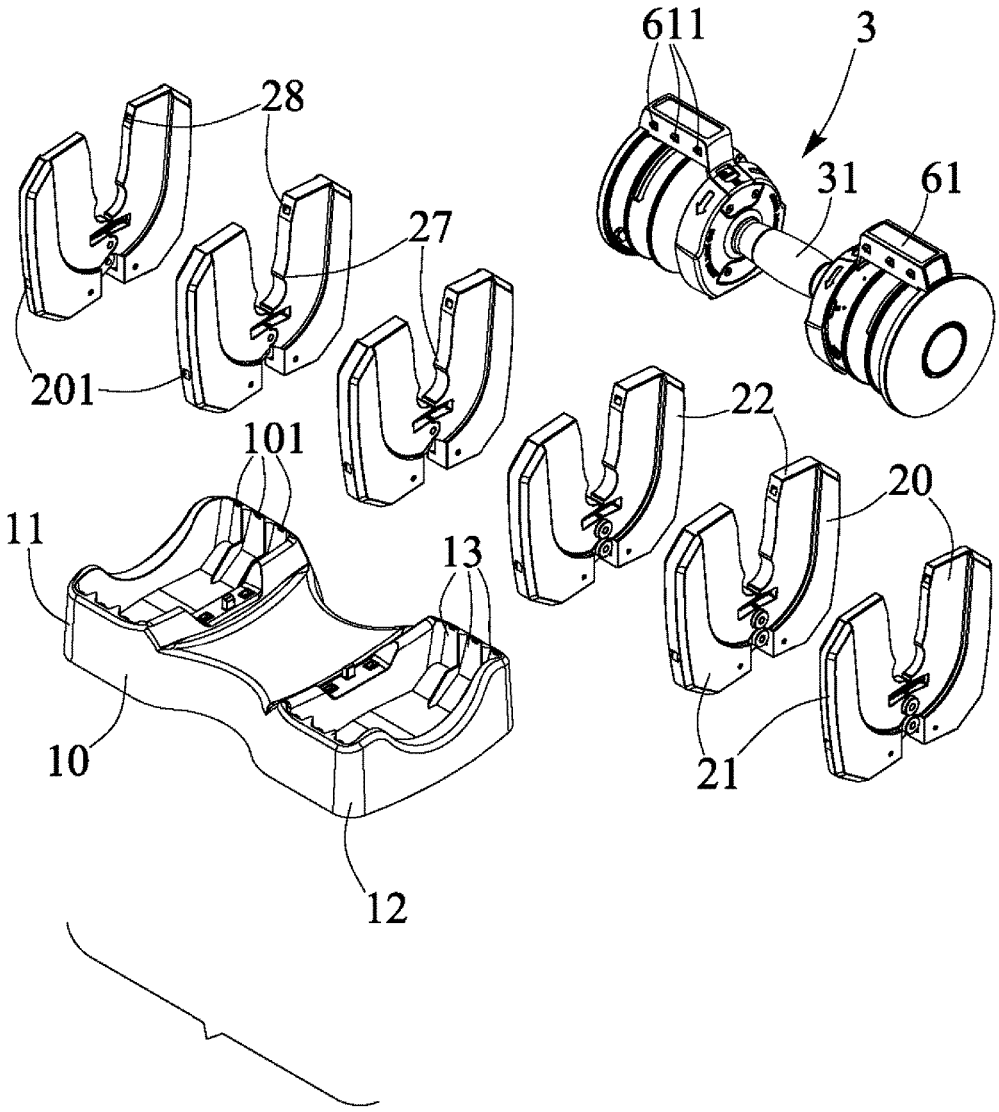
FIG. 23 is a further partial exploded view illustrating the other arrangement of the adjustable dumbbell.
Figure 24:
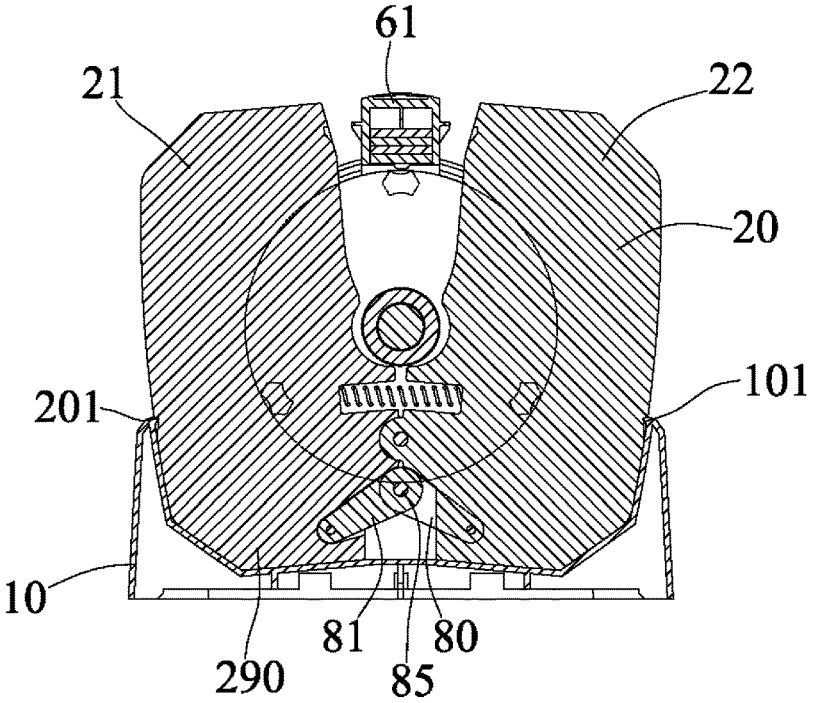
FIGS. 24, 25 are still further cross sectional views of the adjustable dumbbell as shown in FIG. 23.
Figure 25:
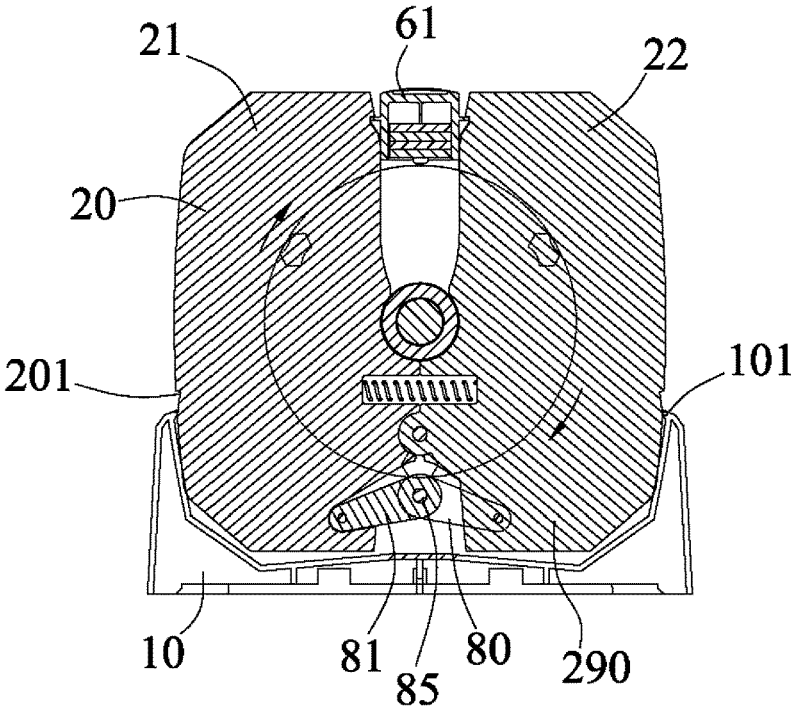

As shown in FIGS. 23-25, the base support 10 may further include a number of latches or catches 101 extended into the socket openings 13 of the base support 10 respectively for selectively engaging with the corresponding depressions or recesses 201 that are formed in the arms 21, 22 of the weight members 20 for selectively anchoring or latching or retaining the weight member 20 to the base support 10 when the lower portions 29 of the arms 21, 22 are pivoted or moved toward each other and for preventing the weight member 20 from being disengaged or separated from the base support 10.

Accordingly, the adjustable exercise device or dumbbell in accordance with the present invention includes an improved compact structure for allowing the weight members to be easily and quickly and readily and adjustably attached to or disengaged from the weight carrier or handle and for allowing the adjustable dumbbell to be easily operated by the users and to give a security to the adjustable exercise device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable exercise device comprising:

a plurality of weight members each including a groove formed in said weight member respectively, and said weight members each including two arms pivotally connected together with a pivot pin for allowing said arms to be pivoted and moved toward or away from each other, said weight members each including a spring biasing member engaged between said arms for biasing said arms away from each other and for opening said groove of said weight member;

a link pivotally connected between said arms;

a handle device including a handle bar having an end portion selectively engageable into said grooves of said weight members, and a hand grip rotatably disposed on said handle bar;

said arms of each of said weight members each including a jaw extended from said arm for selectively engaging with said handle device, and said arms of each of said weight members each including a tongue for anchoring purposes; and a plurality of plates rotatably disposed on said handle bar and rotated in concert with said hand grip relative to said handle bar, said plates being selectively engageable between said weight members, and said plates each including an engaging element for engaging with said link and for moving said arms toward each other to engage with said handle device when said plates and said hand grip are rotated relative to said handle bar, and for selectively anchoring a selected number of weight members to said handle bar of said handle device with said plates.

2. The adjustable exercise device as claimed in claim 1, wherein said handle device includes a follower disposed between said plates and said hand grip and rotated in concert with said plates and said hand grip relative to said handle bar.

3. The adjustable exercise device as claimed in claim 2, wherein said follower includes a plurality of flaps extended from said follower and spaced from each other for forming a plurality of notches between said flaps.

4. The adjustable exercise device as claimed in claim 3, wherein said handle device includes a housing rotatably engaged on said handle bar, and said housing includes a spring biased latch for selectively engaging with either of said notches of said follower and for preventing said follower from being rotated relative to said housing.

5. The adjustable exercise device as claimed in claim 4, wherein said housing includes a casing having a compartment formed in said casing for slidably engaging with said spring biased latch, said casing includes an orifice formed in said casing, and a base support is provided for supporting said weight members, said base support includes a key extended from said base support for selectively engaging with said orifice of said casing.

6. The adjustable exercise device as claimed in claim 5, wherein said base support includes a plurality of socket openings formed in said base support, and a catch extended into each of said socket openings of said base support, and said tongues of said arms of weight members are engageable with said catch of said base support and for anchoring said weight members to said base support.

7. The adjustable exercise device as claimed in claim 4, wherein said housing includes a shank secured to said housing for engaging into said grooves of said weight members and for anchoring said housing to said weight members and for preventing said housing from rotating relative to said weight members.

8. The adjustable exercise device as claimed in claim 7, wherein said shank includes a window formed in said shank, and said follower includes a plurality of ears for selectively aligning with said window of said shank, and said ears each include a numeral for being shown through said window of said shank.

9. The adjustable exercise device as claimed in claim 7, wherein said arms of each of said weight members each include a recess formed in said arm, and said shank includes a plurality of projections for selectively engaging with said recesses of said arms and for anchoring said arms of said weight members to said shank.

10. The adjustable exercise device as claimed in claim 4, wherein said housing includes a spring biased projection engageable with said follower for anchoring and positioning said follower to said housing at selected angular positions, and said follower includes a plurality of depressions formed in said follower for selectively engaging with said spring biased projection.

11. The adjustable exercise device as claimed in claim 4, wherein said follower includes a drum extended from said follower and secured to said hand grip, and said housing is rotatably engaged on said drum.

12. The adjustable exercise device as claimed in claim 1, wherein said arms of said weight members each include an upper portion and a lower portion, said upper portions of said arms are pivotable and moveable toward and away from each other, and said lower portions of said arms are pivotable and moveable toward and away from each other, and said link is pivotally connected between said lower portions of said arms.

13. The adjustable exercise device as claimed in claim 12, wherein said link includes two levers each having a first end portion pivotally connected to said arm with a pivot pin and a second end portion, and said second end portions of said levers are pivotally connected together with a pivot axle.

14. The adjustable exercise device as claimed in claim 13, wherein said link includes a gasket engaged onto said pivot axle.

15. The adjustable exercise device as claimed in claim 1, wherein said plates each include a barrel provided on said plate and rotatably engaged on said handle bar for spacing said plates from each other.

16. The adjustable exercise device as claimed in claim 1, wherein a first plate and a second plate of said plates each include an engaging element, and a third plate of said plates includes three engaging elements.

* * * * *